US006148993A

United States Patent [19]

Chisolm et al.

[11] Patent Number: 6,148,993

[45] Date of Patent: Nov. 21, 2000

[54] KEY-CONCEALING POUCH FOR CARRYING SMALL ARTICLES

[75] Inventors: Beirne Chisolm; Gregg Chisolm, both of Salt Lake City, Utah

[73] Assignee: Chisco, Inc., Salt Lake City, Utah

[21] Appl. No.: 09/379,525

[22] Filed: Aug. 24, 1999

[51] Int. Cl.[7] ..... A45C 11/32

[52] U.S. Cl. ..... 206/38.1; 206/37.4

[58] Field of Search ..... 206/38, 38.1, 37, 206/37.1–37.8; 150/131, 134, 138, 147

[56] References Cited

U.S. PATENT DOCUMENTS

| | | | |
|---|---|---|---|
| 1,139,370 | 5/1915 | Putnam | 206/38.1 |
| 1,255,961 | 2/1918 | Duyke | 206/38.1 |
| 1,693,006 | 11/1928 | Thomas | 206/38.1 |
| 1,762,770 | 6/1930 | Droutman | 206/37.1 |
| 2,071,757 | 2/1937 | Mathews | 206/38.1 |
| 2,571,609 | 10/1951 | Powell | 206/38.1 |
| 2,601,145 | 6/1952 | Hutchinson | 206/38.1 |
| 4,796,750 | 1/1989 | Inghram | 206/37.4 |

*Primary Examiner*—Paul T. Sewell
*Assistant Examiner*—Luan K. Bui
*Attorney, Agent, or Firm*—Morriss, Bateman O'Bryant & Compagni

[57] ABSTRACT

A pouch for retaining small articles or money is disclosed having a key-concealing mechanism associated with a secondary enclosure in which one or more keys may be retained in a concealed fashion until such time as the key or keys are desired for use. The key-concealing mechanism of the present invention is structured to slidably move the key or keys from a position of concealment within the secondary enclosure to a position outside the secondary enclosure where the key or keys can be accessed for use.

4 Claims, 5 Drawing Sheets

KEY-CONCEALING POUCH FOR CARRYING SMALL ARTICLES

BACKGROUND

1. Field of the Invention

This invention relates to purses or pouches for carrying small articles or money, and specifically relates to a pouch configured to slidably conceal a key therewithin.

2. Statement of the Related Art

Purses or pouches have been developed over the centuries in response to the need to conveniently carry money or small articles on or about a person's body. In earlier centuries, such purses or pouches tended to be in the nature of drawstring bags which could be tied to another article of clothing, such as a belt. In later centuries, wallets were developed to be carried in a pocket, such as a trouser pocket, or in a woman's handbag. Wallets are functional for their intended purpose, but tend to be configured only for the carrying of money, credit cards, pictures or other flat, two-dimensional objects. Wallets have also been used to carry a single spare key to, for example, a house or a car, but access to the key is slow and burdensome. For the most part, people tend to carry a separate ring of keys or a key-carrier structured with metal clips or rings and foldable flaps which enclose the keys therewithin. Additionally, key rings have been designed with a small, closable pouch for carrying coinage for emergency phone calls, but the key ring is still bulky and the emphasis of the device.

The later decades of the twentieth century have heralded a new age of, and attitude toward, fashion objectives. In these latter days, there has been a trend toward minimalist and casual clothing which is more comfortable and functional. Clothing accessories have followed suit and have been designed to meet the needs of busy and active people on the go who don't want to be burdened with an abundance of clothing accessories such as bulky wallets, key chains or purses. Therefore, the trend has been toward simplified and functional devices for carrying only the essential items of travel and commerce- money, spare change, credit cards and keys. The objective has also been to provide a one-accessory-accomplishes-all device which is small, unobtrusive and not bulky.

Thus, it would be beneficial in the art to provide a purse or pouch sized to retain small articles or money, which is conveniently carried in a pocket or a woman's handbag, as well as directly on or in an item of clothing, and which is configured to retain in a concealed fashion one or more keys.

SUMMARY OF THE INVENTION

In accordance with the present invention, a pouch which is sized to retain small articles or money is configured to retain in a concealed fashion one or more keys. The pouch of the present invention is structured to provide means for carrying essential items of relatively small size and for carrying one or more keys in a concealed fashion, and is structured to be conveniently carried in a pocket or in the hand. A principal advantage of the present pouch resides in enabling the user of the pouch to tote small essential articles, including one or more keys, in situations where it is undesirable, inappropriate or impractical to employ larger means or capacities for carrying articles, such as a purse, backpack or a multiplicity of pockets. The pouch of the present invention is, therefore, particularly suitable for active and sporting lifestyles. Further, the pouch is structured to maintain the key or keys in a substantially flattened position against the pouch to avoid bulkiness in the pouch.

The pouch of the present invention includes a pouch enclosure for storing and retaining small articles of essential value, such as small amounts of paper money, coinage, credit cards, identifying documentation and the like. The pouch enclosure may, most suitably, include a closure mechanism for securing the pouch enclosure in a closed position, thereby securing articles within the pouch enclosure. However, a closure mechanism is not strictly required. Examples of suitable closure mechanisms include a zipper, snaps, interlocking hook and loop material (e.g. Velcro®) a latch, a flap or the like.

The pouch of the present invention also includes a secondary enclosure which is sized to receive one or more keys therein for concealed engagement therewithin. A key-concealing mechanism is associated with the secondary enclosure which engages one or more keys for retention within the secondary enclosure. The key-concealing mechanism in structured to slidably move one or more keys from a position outside the secondary enclosure to a position within the secondary enclosure to thereby conceal the key or keys within the secondary enclosure. Any suitable mechanism which slidably moves a key or keys from a position outside of the secondary enclosure to a concealed position within the secondary enclosure may be employed in the present invention.

The pouch of the present invention may also include closure structure associated with the secondary enclosure to maintain the key or keys within the secondary enclosure until such time as the key or keys are to be used. Any suitable closure structure may be employed with enables the user to quickly and easily disengage the closure structure to access the key or keys within the secondary enclosure.

The pouch of the present invention is designed to meet the needs of present-day lifestyles, which typically includes the wearing of lighter, more casual clothes having less carrying capacity (i.e., fewer pockets) for toting articles, such as large or heavy wallets or purses. The pouch of the present invention is also designed to meet the needs of active people who engage in sporting activities where it is impossible or impractical to carry a wallet or purse, and pocket space is reduced, but yet there is a need to carry essential items such as money or credit cards and keys. These and other advantages of the present invention will be apparent from the following disclosure of the detailed description of the illustrated embodiments.

BRIEF DESCRIPTION OF THE DRAWINGS

In the drawings, which illustrate what is currently considered to be the best mode for carrying out the invention.

DETAILED DESCRIPTION OF THE ILLUSTRATED EMBODIMENTS

Figure 1:
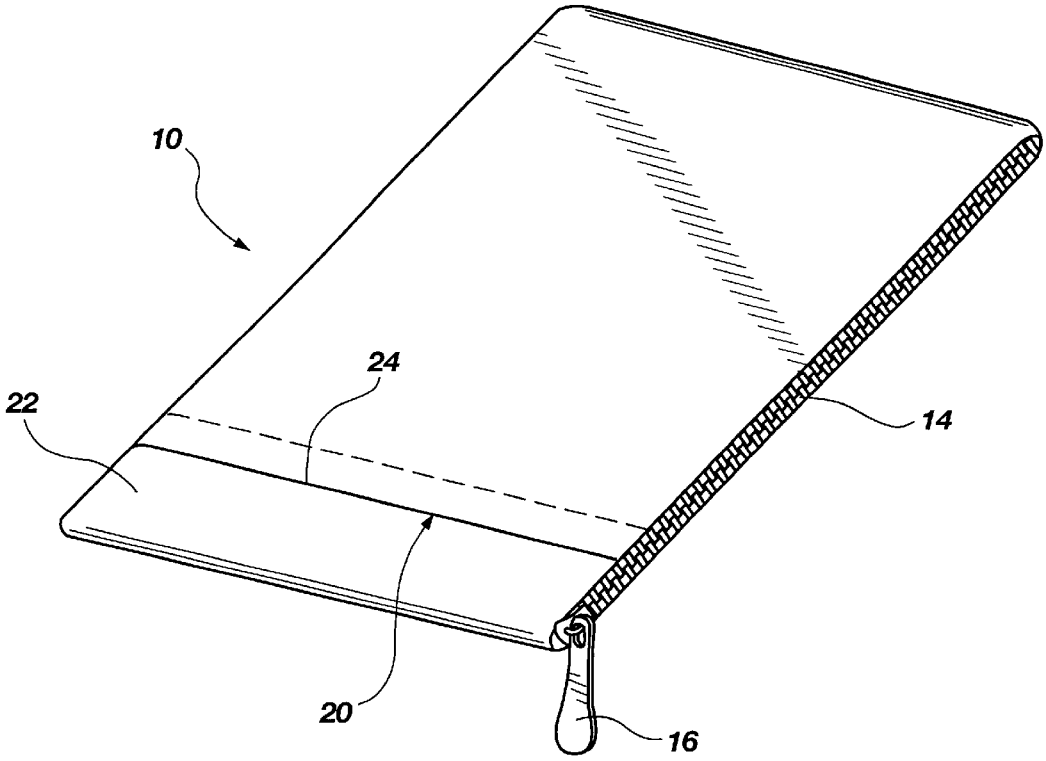
FIG. 1 is a perspective view of a general embodiment of the present invention.
Figure 2:
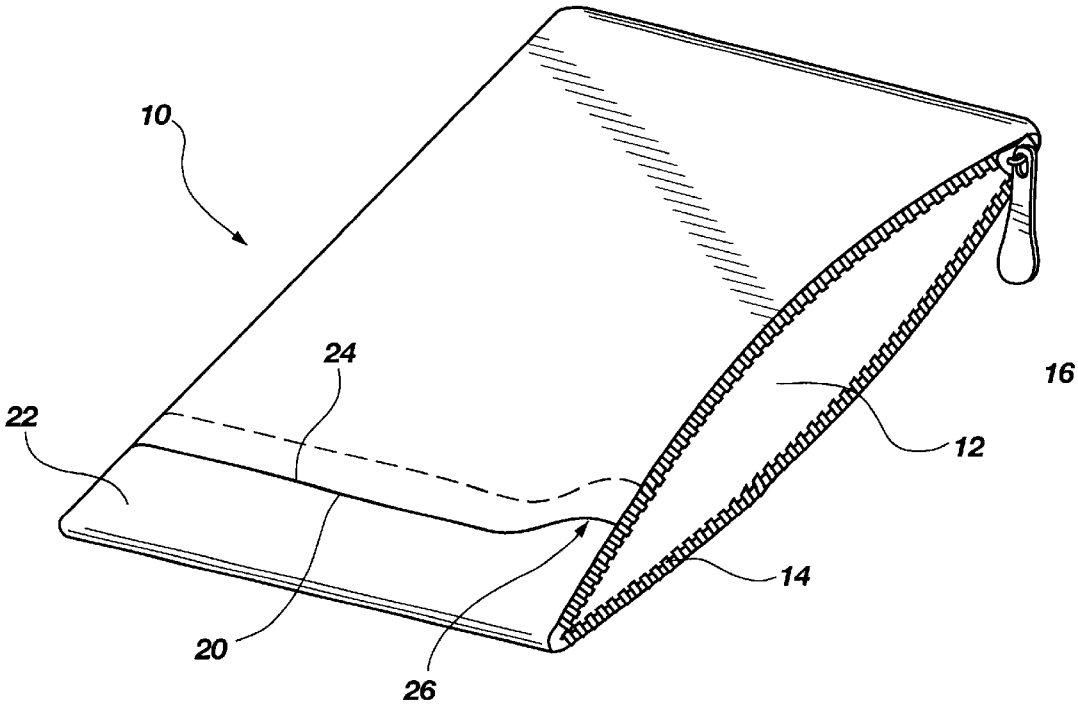
FIG. 2 is a perspective view of the pouch shown in FIG. 1 illustrating the opening to the pouch enclosure and the opening to the secondary enclosure.

FIGS. 1 and 2 generally illustrate the pouch 10 of the present invention, which comprises a pouch enclosure 12 sized to receive and retain small articles, such as paper money, coinage, credit cards, identifying documentation (e.g., driver's license) and the like therein. The pouch 10 is shown in FIGS. 1 and 2 as being generally rectangular in shape, but the pouch may be any suitable shape, including round, square, octagonal, etc. The dimensions of the pouch 10 may vary as well, and may generally range between about 1½ inches by 1½ inches to about five inches by five inches, although larger or smaller dimensions may be desirable. It is only important that the pouch be large enough to retain in a concealed fashion one or more keys, as described more fully hereinafter. The pouch 10 of the present invention may be made of any suitable material, including animal skin (e.g., leather) or any man-made or natural fabric material.

The pouch enclosure may preferably, as shown, include a closure mechanism 14 for selectively opening and closing the pouch enclosure 12, thereby securing within the pouch enclosure 12 any articles placed therein. A closure mechanism is not specifically required, however. By way of example only, the closure mechanism 14 is illustrated as being a zipper 16. However, many other suitable closure mechanisms 14 may be employed, such as snaps, interlocking hook and loop material, latches, a flap of fabric, or the like.

The pouch 10 of the present invention further includes a secondary enclosure 20 which, for example, may comprise a dimension of material positioned on the outside 22 of the of the pouch 10 and having an edge 24 defining an opening 26 into the secondary enclosure 20. The secondary enclosure 20 is sized in dimension to receive and retain at least one key therein.

Figure 3:
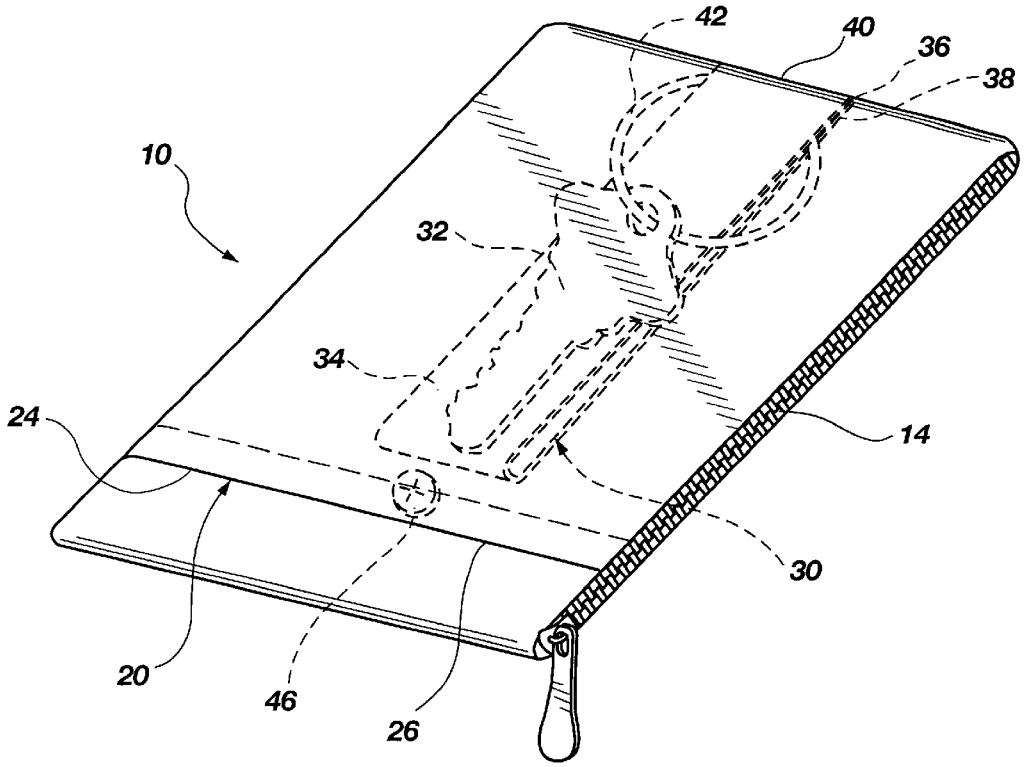
FIG. 3 is a perspective view of a first embodiment of the present invention illustrating, in phantom, a key-concealing mechanism.
Figure 4:
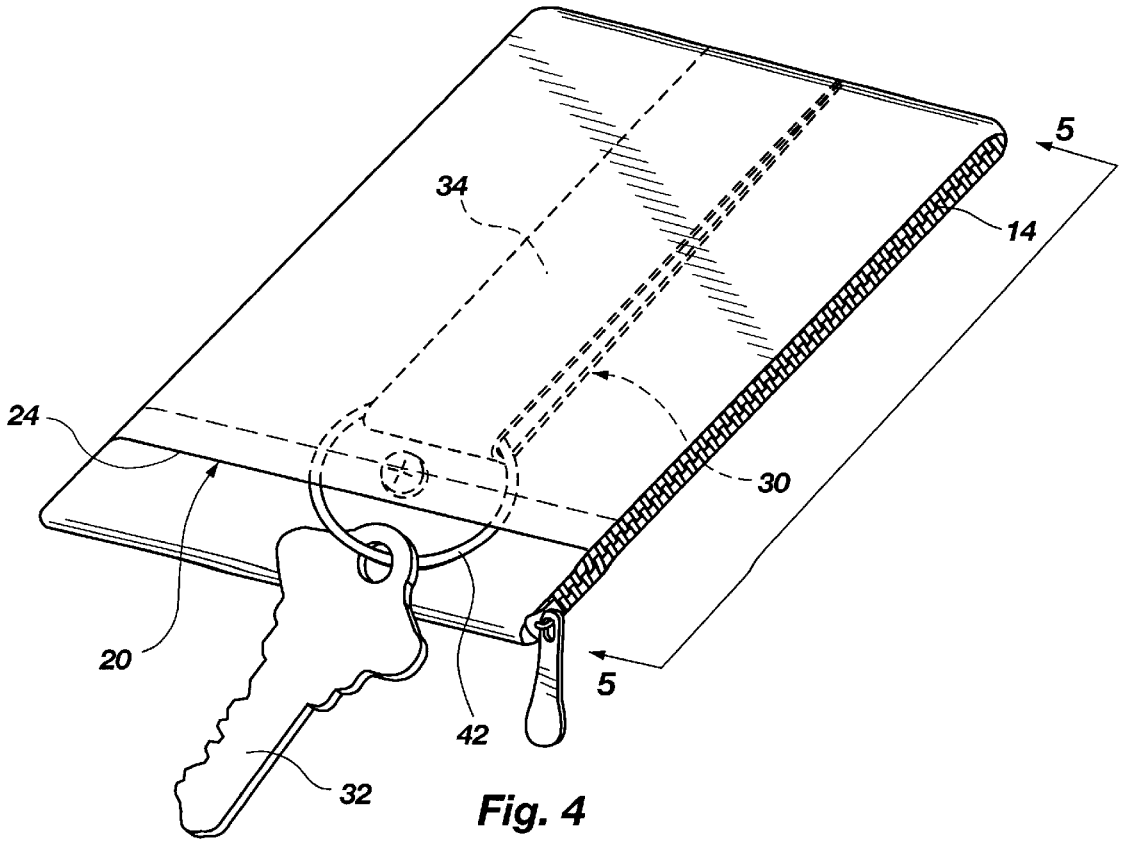
FIG. 4 is a perspective view of the pouch shown in FIG. 3 where the key is shown in a position outside the secondary enclosure.

FIGS. 3 and 4 illustrate further that, in accordance with the present invention, a key-concealing mechanism 30 (shown in phantom) is located within the secondary enclosure 20 and is configured to slidably move at least one key 32 from a position within the secondary enclosure 20, as shown in FIG. 3, to a position outside the secondary enclosure 20, as shown in FIG. 4. In the particular embodiment illustrated in FIGS. 3 and 4, the key-concealing mechanism 30 comprises a loop 34 of material having two ends 36, 38 which are both connected to one end 40 of the pouch 10 within the secondary enclosure 20. The key-concealing mechanism 30 further includes a ring 42 which is positioned through the loop 34 of material and is, therefore, slidable along the length of the loop 34 of material. The ring 42 is sized to retain one or more keys 32 thereon. Because the ring 42 is capable of sliding along the loop 34 of material, it can be seen that the key 42 is movable from a position within the secondary enclosure 20 to a position outside the secondary enclosure 20 where it is accessible for use. In this most simplified embodiment of the invention, a quick downward snap of the pouch 10 will urge the key 42 out of the secondary enclosure 20 for ready access.

It may be desirable to configure the pouch 10 of the present invention with a closure structure 46, as shown in phantom in FIG. 3, which operates to selectively secure the opening 26 to the secondary enclosure 20, thereby securing the key 42 within the secondary enclosure 20. The closure structure 46 may be any suitable device, but is illustrated herein, by way of example only, as a snap.

Figure 5:
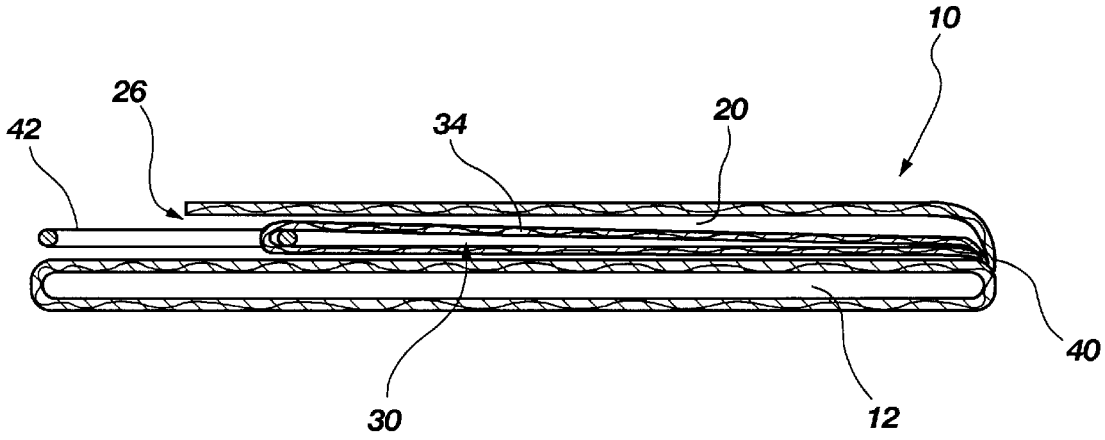
FIG. 5 is a view in cross section of the pouch shown in FIG. 4, taken at lines 1—1.
Figure 6:
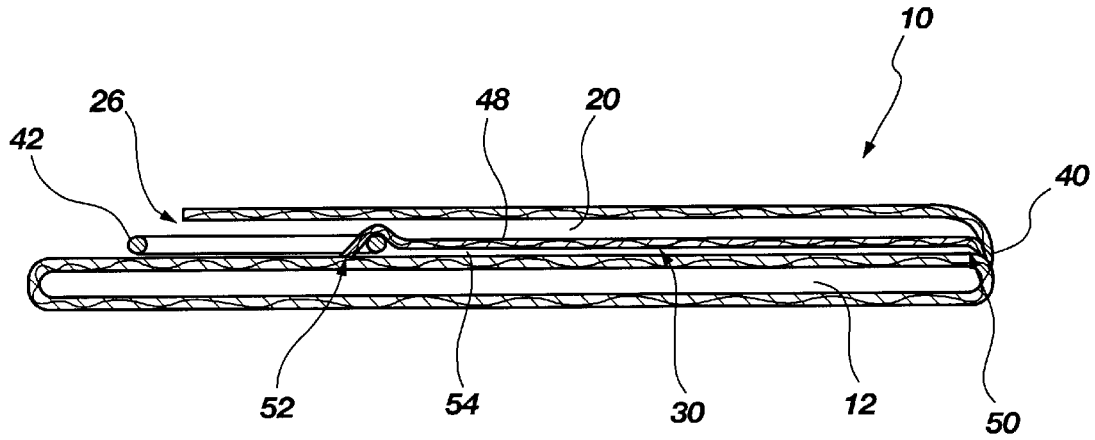
FIG. 6 is a view in cross section of a pouch illustrating a second embodiment of the key-concealing mechanism.

The positioning of the key-concealing mechanism 30 within the secondary enclosure 20, as illustrated in FIGS. 3 and 4, is further illustrated in FIG. 5 which presents a cross section view. It can be seen from FIG. 5, that the loop 34 of material comprising the key-concealing mechanism 30 is secured at one end 40 of the pouch 10 and that the ring 42 is positioned through the loop 34. An alternative key-concealing mechanism 30 is illustrated in FIG. 6 in which a placket 48 of material has one end 50 secured to the end 40 of the pouch 10 and another end 52 secured to the pouch 10 away from the end 40 of the pouch 10. A space is thus provided between the ends 50, 52 of the placket 48 along which a ring 42 may slide back and forth to move a key from a position within the secondary enclosure 20 to a position outside the secondary enclosure 20. Any other type of material loop, placket or similar device may be employed for slidably moving a ring therealong as previously described.

Figure 7:
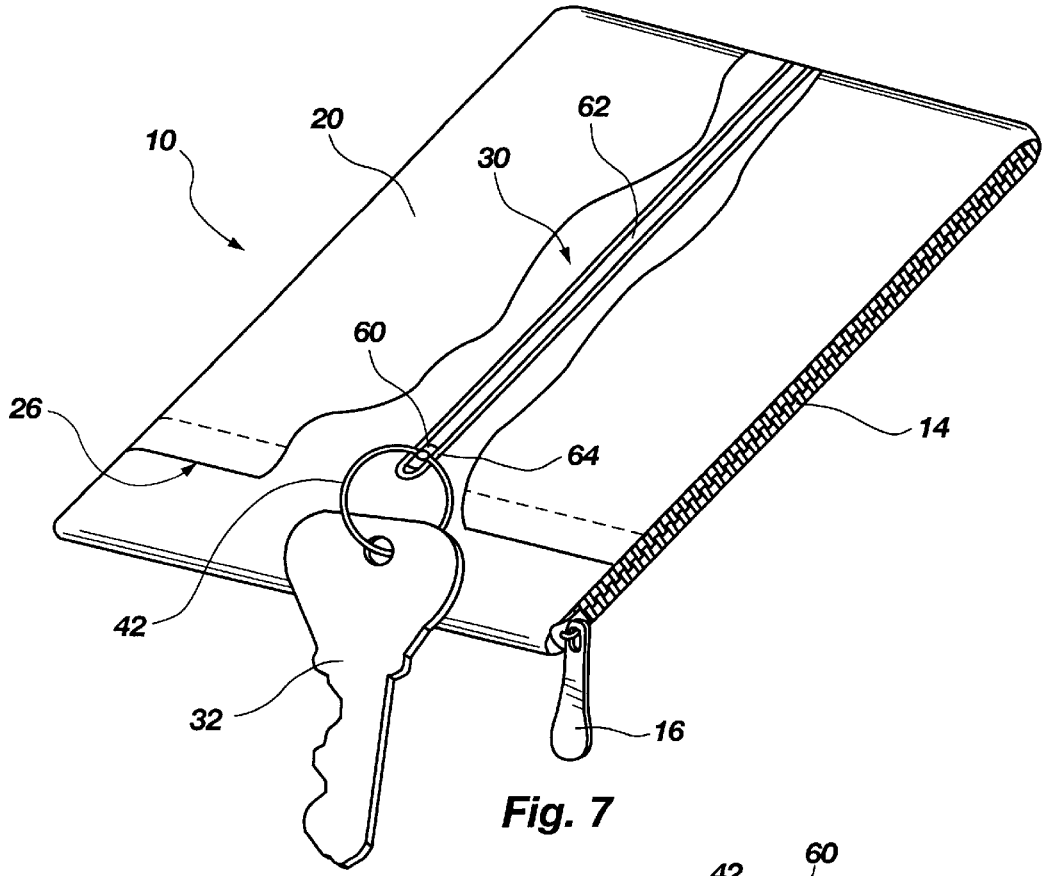
FIG. 7 is a perspective view, in partial cutaway, illustrating a third embodiment of the key-concealing mechanism where the key is positioned outside of the secondary enclosure.
Figure 8:
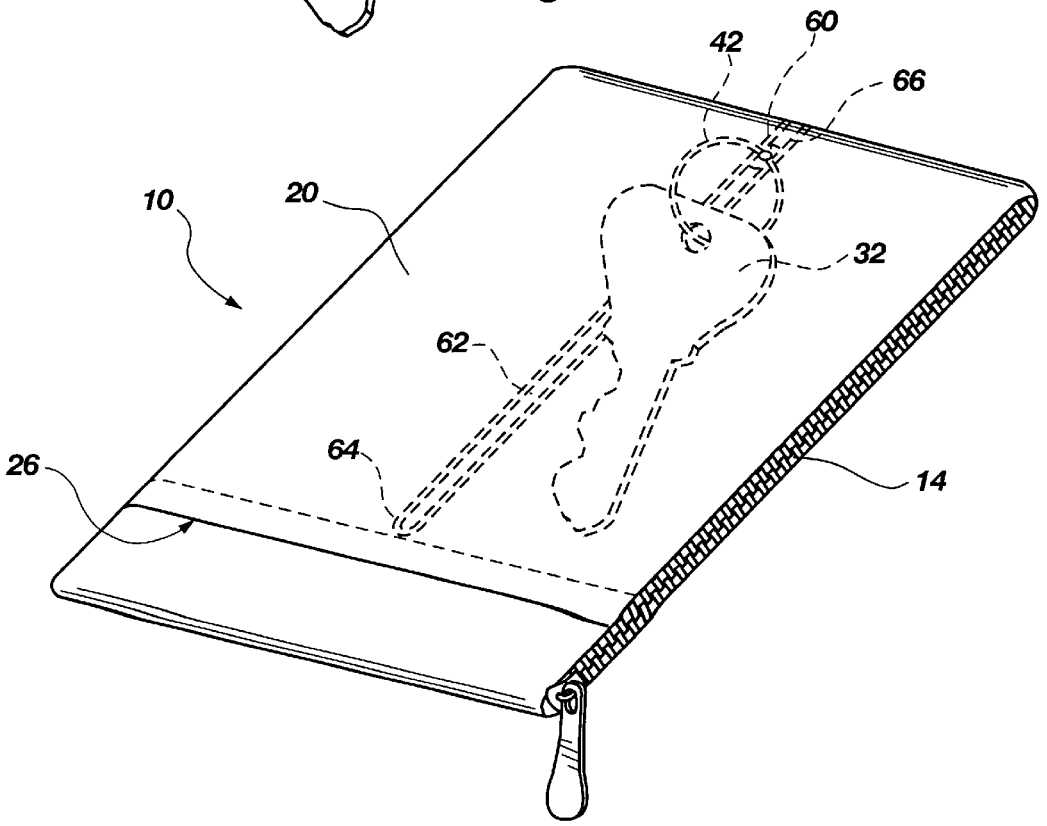
FIG. 8 is a perspective view of the embodiment shown in FIG. 7 where the key, shown in phantom, is positioned within the secondary enclosure.

Another alternative structure for providing a key-concealing mechanism 30 is shown in FIGS. 7 and 8 where the key-concealing mechanism 30 comprises a tab 60 slidably positioned within a track 62 located within the secondary enclosure 20. The tab 60 and track 62 may, for example, be made of nylon or plastic material, thereby rendering the key-concealing mechanism 30 flexible. However, metal or any other suitable material may be employed. A ring 42 is attached to the tab 60. The ring 42 is sized to receive one or more keys thereon. When the tab 60 is moved to the farthest end 64 of the track 62 near the opening 26 of the secondary enclosure 20, as shown in FIG. 7, the key 32 is positioned outside the secondary enclosure 20 and is accessible for use. When the tab 60 is slidably moved to the opposite end 66 of the track 62, as shown in FIG. 8, the key 32 is withdrawn into the secondary enclosure 20 and is concealed from view.

Insertion of a finger in the opening 26 of the secondary enclosure 20 enabling the grasping of the key 32 permits the key 32 to be slidably moved to a position outside of the secondary enclosure 20 as shown in FIG. 7. Likewise, urging the key 32 back into the secondary enclosure 20 will cause the tab 60 to slide along the track 62 until it reaches the opposite end 66 of the track 62 to conceal the key 32.

Figure 9:
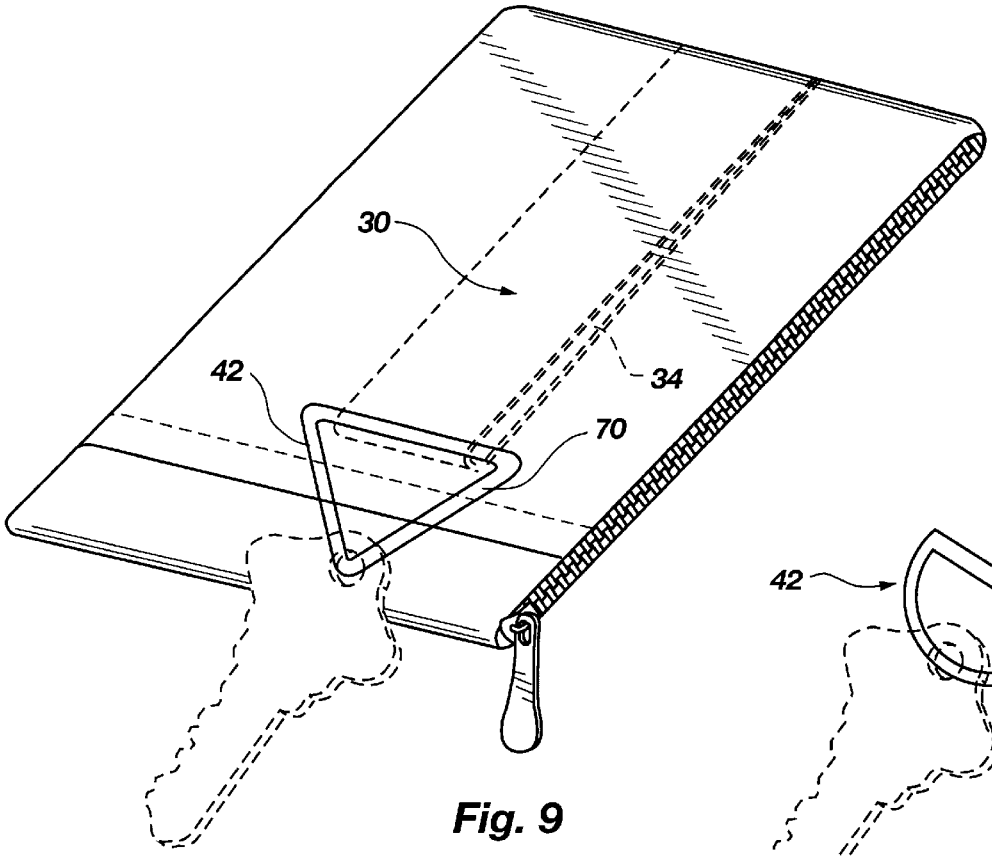
FIG. 9 illustrates an alternative embodiment of a ring for engaging a key.
Figure 10:
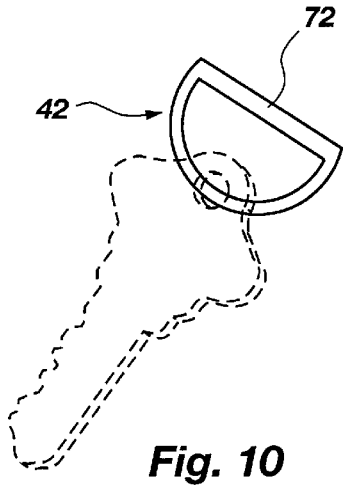
FIG. 10 illustrates another alternative embodiment of a ring for engaging a key.
Figure 11:
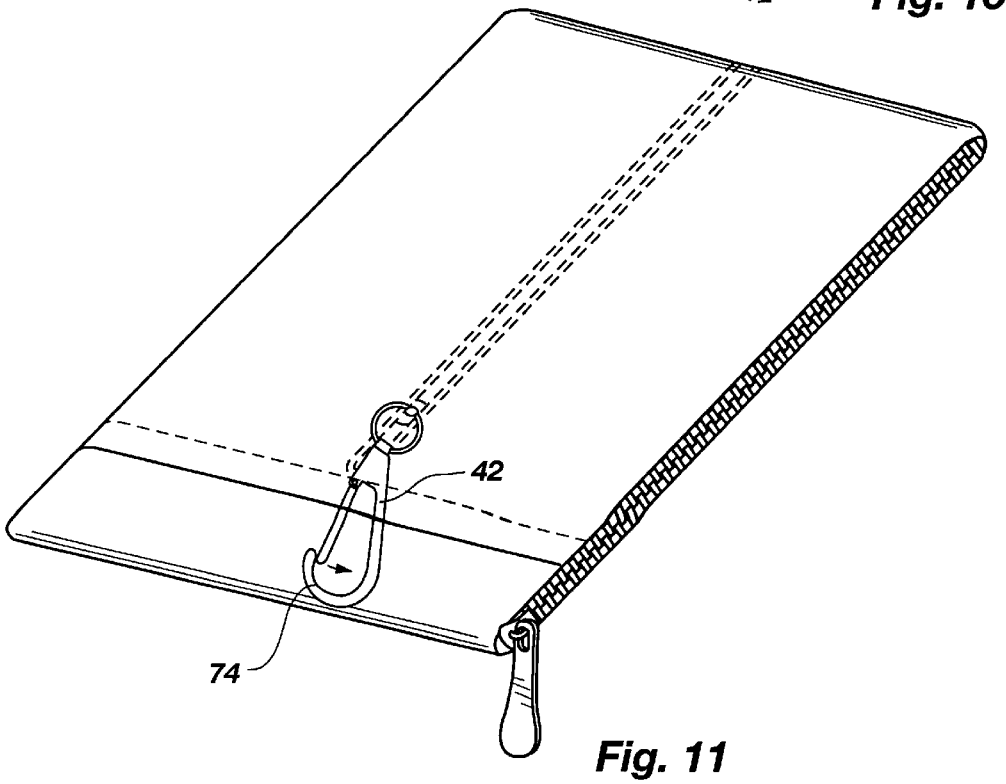
FIG. 11 illustrates yet another alternative embodiment of a device for engaging a key.

As used herein, the term "ring" is meant to include any number of different sizes, shapes or dimensions of a device configured to receive and retain one or more keys thereon. Examples of non-traditional (i.e., non-circular) rings suitable for use in the present invention are illustrated in FIGS. 9–11. In FIG. 9, a triangular-shaped ring 70 is employed to slidably move along the loop 34 of material of a key-concealing mechanism 30. Alternatively, as shown in FIG. 10, the ring 42 may be a D-ring 72. As shown in FIG. 11, the ring 42 may be fashioned as a spring-loaded hook 74 which enables easy attachment and detachment of keys thereto. It is understood that any ring 42 employed in the pouch of the present invention is intended to be configured for selective attachment and detachment of one or more keys.

The key-concealing retaining pouch of the present invention is configured to provide convenience in toting small articles or money on or about a person, and to conceal the carrying of one or more keys in connection with the pouch. The pouch of the present invention can be adapted to use in any variety of situations and may be manufactured in any number of suitable sizes or dimensions. Thus, reference herein to specific details of the illustrated embodiments is by way of example and not by way of limitation. It will be apparent to those skilled in the art that many additions, deletions and modifications to the illustrated embodiments of the invention may be made without departing from the spirit and scope of the invention as defined by the following claims.

What is claimed is:

1. A retaining pouch for small articles comprising:

a pouch enclosure for storing articles within, said pouch enclosure having a closure mechanism for selectively closing said pouch enclosure;

a secondary enclosure attached externally to said pouch for retaining at least one key; and a key-concealing mechanism positioned within said secondary enclosure for enabling slidable movement of at least one key from a first position outside said secondary enclosure to a second position of concealment inside said secondary enclosure.

2. The retaining pouch of claim 1 wherein said secondary enclosure further includes closure structure for selectively closing said secondary enclosure.

3. The retaining pouch of claim 1 wherein said key-concealing mechanism further comprises a loop positioned within said secondary enclosure through which is secured a key-retaining ring structured to slidably move along said loop to move said at least one key from said first position outside said secondary enclosure to said second position inside said secondary enclosure.

4. The retaining pouch of claim 1 wherein said key-concealing mechanism further comprises a key-retaining ring slidably attached to an elongated track positioned within said secondary enclosure.

* * * * *